US005346143A

United States Patent [19]

Askin

[11] Patent Number: 5,346,143

[45] Date of Patent: Sep. 13, 1994

[54] FISH MINCER PUMP

[75] Inventor: Ronald C. Askin, Glendive, Mont.

[73] Assignee: Crisafulli Pump Company, Inc., Glendive, Mont.

[21] Appl. No.: 91,025

[22] Filed: Jul. 14, 1993

[51] Int. Cl.[5] ..... B02C 23/36

[52] U.S. Cl. ..... 241/46.017; 241/46.06; 241/46.08; 241/69; 241/82.4

[58] Field of Search ..... 241/46.02, 46.06, 46.08, 241/46.017, 69, 82.4, 82.5, 160, 165.5, 82.7

[56] References Cited

U.S. PATENT DOCUMENTS

| | | | |
|---|---|---|---|
| 2,090,650 | 8/1937 | Yant | 241/82.4 |
| 2,710,035 | 6/1955 | Plummer | 241/46.017 X |
| 4,052,009 | 10/1977 | Penque | 241/46.017 X |
| 4,240,591 | 12/1980 | Schnell | 241/82.4 |
| 4,358,061 | 11/1982 | Richter | 241/82.4 |
| 4,844,372 | 7/1989 | Weiler et al. | 241/82.4 |

FOREIGN PATENT DOCUMENTS

| | | | |
|---|---|---|---|
| 127065 | 12/1984 | European Pat. Off. | 241/82.4 |
| 44750 | 10/1888 | Fed. Rep. of Germany | 241/82.4 |
| 64512 | 9/1892 | Fed. Rep. of Germany | 241/82.4 |
| 94721 | 7/1896 | Fed. Rep. of Germany | 241/82.4 |
| 329351 | 4/1958 | Switzerland | 241/82.4 |
| 1493313 | 7/1989 | U.S.S.R. | 241/82.5 |

*Primary Examiner*—Mark Rosenbaum

*Assistant Examiner*—Frances Han

*Attorney, Agent, or Firm*—Jacobson, Price, Holman & Stern

[57] ABSTRACT

A fish mincer pump which includes a conventional chopper plate and cutter knife associated with the inlet of a centrifugal pump and a novel and unique mincer plate and a cutter knife or cutter knives associated with the mincer plate in the inlet of the pump and in inwardly spaced relation from the chopper or shear plate and cutter knife in order to chop fish parts such as fish heads and internal components that are to be discharged into the ocean into a ½ inch maximum solid size in order to comply with regulations which require that fish waste to be discharged into the ocean must not include components exceeding a maximum dimension of ½ inch. The mincer plate has a plurality of openings extending therethrough and oriented substantially throughout the entire area of the plate with each of the holes being not greater than ½ inch in diameter with the cutting knives associated with the mincer plate being on both sides of the mincer plate and having sharpened edge components in the form of bevelled edges to provide a cutting edge which moves along the surfaces of the mincer plate to assure that all fish waste passing through the mincer plate will not exceed ½ inch in maximum dimension.

13 Claims, 1 Drawing Sheet

FISH MINCER PUMP

BACKGROUND OF THE INVENTION

1. Field of the Invention

The present invention generally relates to a centrifugal pump, having a structure for chopping material entering the inlet of the pump. More specifically, the invention relates to a fish mincer pump which includes a chopper or shear plate and cutter knife associated with the chopper or shear plate on the inlet of the pump and a novel and unique mincer plate and a cutter knife or cutter knives associated with the mincer plate in the inlet of the pump and in inwardly spaced relation from the chopper or shear plate and cutter knife in order to mince fish waste parts such as fish heads and internal components that are to be discharged into the ocean into a ½ inch maximum solid size in order to comply with regulations. which require that fish waste to be discharged into the ocean must. not include components exceeding a maximum dimension of ½ inch. The mincer plate has a plurality of openings extending therethrough and oriented substantially throughout the entire area of the plate with each of the holes being not greater than ½ inch in diameter with the cutting knives associated with the mincer plate being on one or both sides of the mincer plate and having sharpened leading edge components in the form of bevelled edges to provide cutting edges which moves along the surfaces of the mincer plate to assure that all fish waste passing through the mincer plate will not exceed ½ inch in maximum dimension since the holes in the mincer plate and the thickness of the mincer plate does not exceed ½ inch. By the introduction of the mincer plate and cutter knives mounted on the impeller shaft of the pump in inwardly spaced relation to a conventional chopper plate and a cutter knife associated with the outer surface thereof which is also supported on and driven by the impeller shaft, existing centrifugal pumps with a chopper unit can be readily converted to a centrifugal pump with the mincer plate and cutter knives thereby providing an efficient and effective structure for chopping fish waste into small particles which meet regulations for pumping fish waste into the ocean.

2. Description of the Prior Art

In the fishing industry, current practice involves discharge of fish waste resulting from processing of the catch directly back into ocean. The fish waste is normally deposited in a holding tank and the fish waste along with water entraining the waste is pumped from the holding tank into the ocean. The pump is a centrifugal pump having the capability of pumping the slurry formed by the fish waste and water and usually includes a chopping assembly in the inlet. The chopping assembly includes a chopper plate stationarily mounted in the inlet and a rotatable cutter knife associated with the outer surface of the chopper plate to chop fish waste. The chopper plate utilizes four relatively large, arcuate openings defined by four radial spokes with the rotating knife chopping or shearing the fish waste. However, this structure does not chop the fish waste into maximum size ½ inch components that will satisfy present regulations that require all particles of fish waste discharged into the ocean to be no larger than ½ maximum size. It is also well known to provide meat grinding devices in which meat is chopped and then extruded through a perforated plate. The following U.S. Pat. Nos. are relevant to this field of endeavor.

43,520
348,132
412,557
429,850
3,667,692
4,003,521
4,512,523

None of the patents listed above disclose the concept of utilizing a mincer plate and cutter knife or knives associated with the inlet of a centrifugal pump used for discharging fish waste into the ocean.

SUMMARY OF THE INVENTION

An object of the present invention is to provide a fish mincer pump which includes a mincer plate and cutter knife or cutter knives associated therewith with the mincer plate being mounted in the inlet of a centrifugal pump and the cutter knife or knives being mounted on and driven by the pump impeller shaft to mince fish waste into maximum size not exceeding ½ inch in order to meet current regulations for discharging fish waste into the ocean.

Another object of the invention is to provide a fish mincer pump in accordance with the preceding object in which the pump includes a chopper or shear plate and cutter knife associated with the pump inlet with the mincer plate and cutter knife or knives being positioned inwardly of and in spaced relation to the chopper or shear plate and in the inlet of the centrifugal pump to mince the fish waste, including fish heads and internal fish components and other fish waste components, into a maximum size not in excess of ½ inch.

A further object of the invention is to provide a mincer assembly which can be readily incorporated into the inlet of a centrifugal pump to chop and mince fish waste to an acceptable level set forth by present fishing industry regulations so that the pumpage can be discharged back into the ocean with the structure of the mincer plate and cutter knives being relatively simple, efficient, long lasting and dependable.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
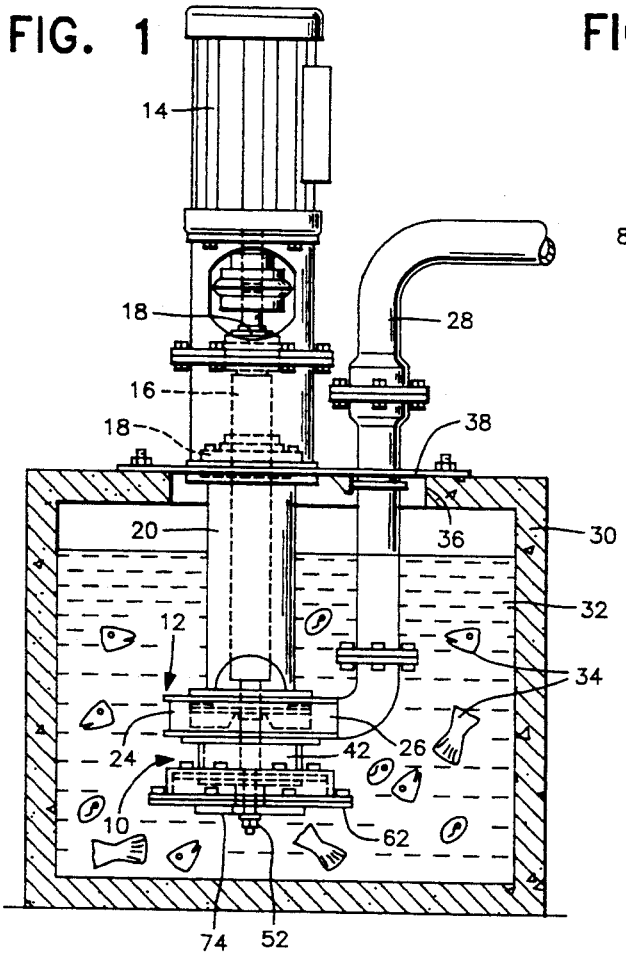
FIG. 1 is an elevational view of the fish mincer pump of the present invention illustrating the association of the pump with a holding tank or well receiving fish waste and water with the pump discharging water and minced fish waste.
Figure 3:
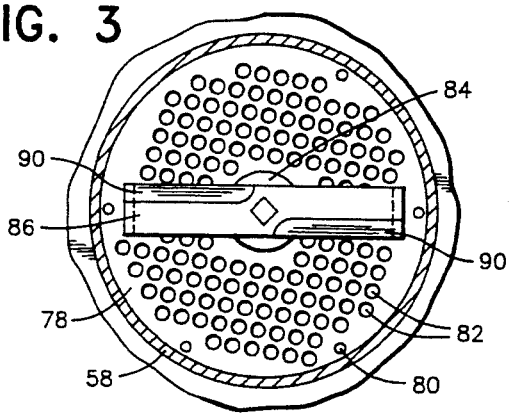
FIG. 3 is a plan view of the mincer plate and a cutter knife associated therewith.

Referring now specifically to the drawings, the fish mincer pump of the present invention is generally designated by reference numeral 10 and is associated with a centrifugal pump 12 which includes an electric drive motor 14 having an output shaft 16 supported by bearing structures 18 with the drive shaft 16 extending below a lower bearing 18 concentrically through a support structure 20 for driving engagement with a pump impeller 22 positioned in a casing 24 and provided with a tangential discharge 26 connected with a discharge pipe 28. The pump 12 is inserted into a holding tank or well 30 having a quantity of water 32 therein and fish waste 34 including fish heads, internal components and other waste components resulting from processing fish with the tank or well receiving the waste material from the processing plant. The pump assembly is inserted into the well through an opening 36 and is supported in position by a plate 38. The above structure of the pump and drive mechanism represents a conventional structure with the impeller 22 being capable of handling solids and is semi-open.

Figure 4:
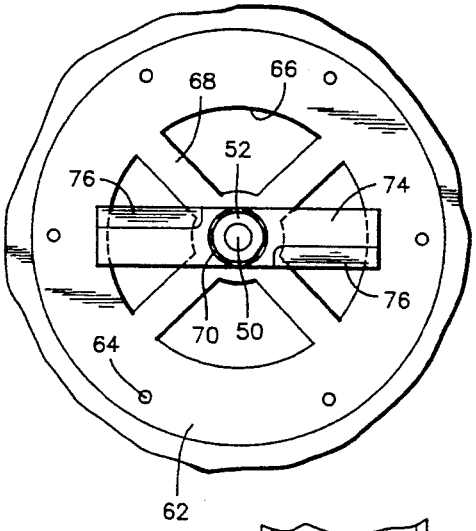
FIG. 4 is a bottom view of the conventional chopper plate and cutter knife associated therewith.
Figure 2:
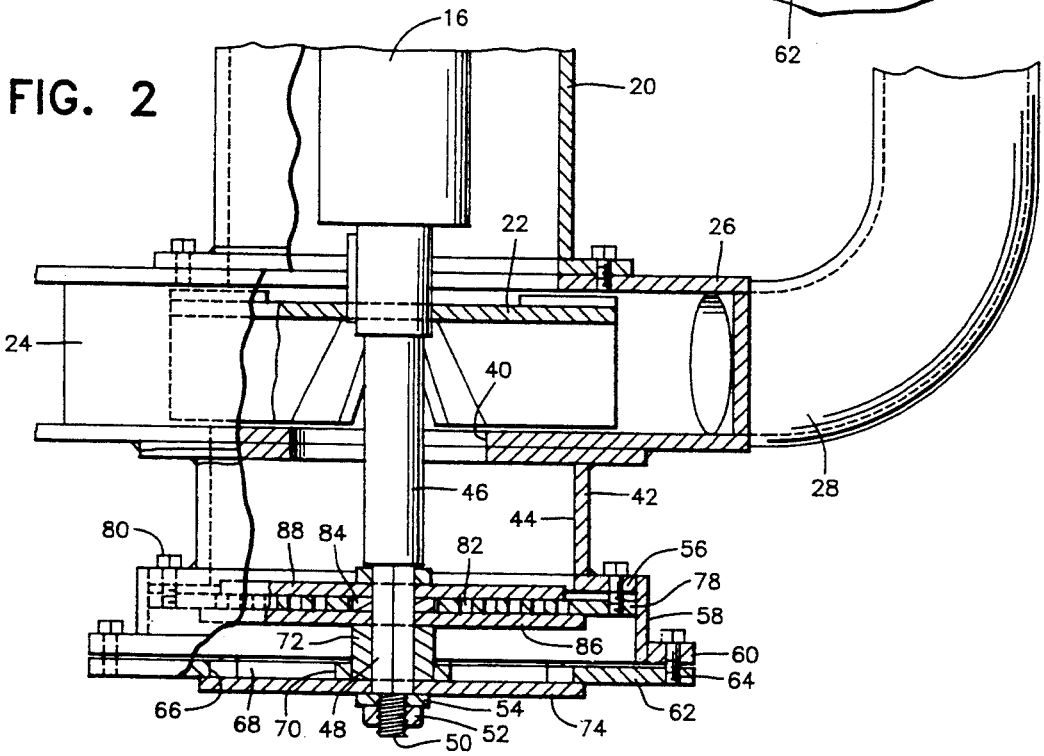
FIG. 2 is a vertical sectional view of the fish mincer pump, on an enlarged scale, illustrating the structural association of the components of the fish mincer pump.

The bottom of the casing 24 has suction inlet opening 40 and a depending cylindrical adapter or extension 42 is attached to the casing and includes a passageway 44 which provides flow to the suction inlet opening 40. Also, the shaft 16 includes a reduced extension 46 which extends through the suction inlet opening 40 and the passageway 44 with the lower end of the shaft extension including a polygonal or square lengthwise area 48 having a reduced threaded lower end 50 receiving a retaining nut 52 and washer 54. The lower end of the cylindrical extension 42 includes an outwardly extending flange 56 which terminates in a depending cylindrical extension 58 terminating in an outwardly extending flange 60. Attached to the flange 60 is a chopper or shear plate 62 secured in place by fastening bolts 64 with the chopper or shear plate 62 being disclosed in FIG. 4 and including four large arcuate openings 66 defined by four spokes 68 which extend inwardly and define a circular hub 70 that receives a bushing 72 mounted on the square portion 48 of the shaft 46 which stabilizes and supports the shaft and enables the shaft to rotate while the chopper or shear plate 62 remains stationary. A chopper or shear knife or blade 74 is mounted on the lower end of the shaft 46 below the chopper or shear plate 62 with the square opening through the chopper or shear knife or blade 74 connecting the blade 74 to the square portion 48 of the shaft 46 in order for the blade 74 to rotate with the shaft. The blade 74 is retained in place by the washer 54 and retaining nut 52 and opposite longitudinal edges 76 of the blade 74 are bevelled and are closely associated with the spokes 68 to chop or shear fish waste passing inwardly through the large openings 66. However, in view of the size of the openings 66, the blade 74 will not chop the fish waste sufficiently to comply with current regulations which require that all fish waste to be pumped back into the ocean must not exceed ½ inch in maximum dimension.

By using the fish mincer of the present invention, the regulations can be complied with inasmuch as the fish mincer includes a mincer plate 78 of circular configuration extending in underlying relation to the flange 56 and being secured thereto by bolt type fasteners 80. The mincer plate 78 includes a plurality of holes or apertures 82 in perpendicular relation to the surfaces of the plate with the holes occupying substantially the entire area of the circular plate inwardly of the passageway 44 so that all fish waste passing therethrough will have a diameter not greater than ½ inch. The center of the mincer plate 78 includes a bushing 84 receiving the square portion 48 of the shaft 46 to enable the shaft to rotate in relation to the mincer plate.

Associated with the mincer plate 78 is a rotating cutter knife or blade 86 associated with the bottom surface of the mincer plate 78 and a second cutter knife or blade 88 associated with the upper surface of the mincer plate 78. The blades extend for a distance to cut all material passing through the holes 82 and each blade includes a bevelled sharpened edge portion 90 on opposite longitudinal edges of the blade in order that all material passing into and through the holes 82 will be chopped, sheared or minced in a manner that all fish. waste material passing upwardly through the mincer plate 78 will be engaged by the blades 86 and 88 and the association of the bevelled edges 90 with the surfaces of the mincer plate 78 will effectively chop, shear and mince all of the fish waste into size components not greater than ½ inch maximum dimension.

As set forth, the unique improvement incorporated into the mincer pump of the present invention is the use of the mincer plate 78 and the cutter knife or knives 86 and 88 in the suction inlet of the centrifugal pump 10 and inwardly of the conventionally used chopper or shear plate 62 and cutter knife or blade 74. This structure chops, shears and minces fish waste including fish heads, internal components and other waste material in a manner that will satisfy regulations that require all particles discharged into the ocean have a maximum solid size not to exceed ½ inch.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention

What is claimed as new is as follows:

1. A fish mincer pump comprising a centrifugal pump including a casing having a suction inlet opening in one wall thereof and a tangential discharge, an impeller in said casing connected to and driven by a pump shaft, said casing including a generally cylindrical inlet extension extending laterally from said suction inlet opening, said pump shaft extending coaxially through said extension, a chopper plate mounted on an end of said extension remote from the pump, said chopper plate including a plurality of large arcuate openings defined by radial spokes, a chopper knife mounted on an end of said pump shaft with the chopper knife including sharpened edge portions associated with a surface of the chopper plate remote from said extension, the improvement comprising a mincer plate mounted on said extension between the chopper plate and pump inlet opening, said mincer plate being spaced axially from the chopper plate and including a plurality of small holes extending therethrough, a cutter knife drivingly connected to said pump shaft, said cutter knife being disposed in spaced relation to the chopper plate and including sharpened edge portions closely associated with one surface of said mincer plate to chop fish waste passing through the holes in the mincer plate whereby all fish waste passing into the inlet opening of the centrifugal pump will have a maximum size determined by the size of the holes in the mincer plate and the shearing action between the rotatable cutter knife and mincer plate.

2. The fish mincer pump as defined in claim 1 wherein said cutter knife is associated with a surface of the mincer plate remote from the pump inlet opening, a second cutter knife drivingly connected to said pump shaft and associated with a surface of the mincer plate adjacent the pump inlet opening.

3. The fish mincer pump as defined in claim 2 together with means removably and adjustably mounting the mincer plate and chopper plate on the extension.

4. The fish waste pump as defined in claim 3 wherein said means mounting the mincer plate and chopper plate on the extension includes longitudinglly spaced, laterally outwardly extending flanges on the extension to define a pair of longitudinglly spaced shoulders connected by an offset portion of said extension, said plates having a peripheral portion engaged with said flanges and bolt type fastening means extending through the flanges and a peripheral portion of the mincer plate and chopper plate to detachably secure the plates in position and enable adjustment thereof, said pump shaft including means on an outer end thereof removably securing the knives, chopper plate and mincer plate on the pump shaft.

5. The fish mincer pump as defined in claim 4 wherein each of said knives includes longitudinally extending bevelled portions on opposite longitudinal edges thereof to form sharpened edge portions thereon with the sharpened edge portions being in shearing relation to the chopper plate and mincer plate for chopping material passing therethrough.

6. The fish waste pump as defined in claim 4 wherein said pump shaft includes an elongated polygonal portion drivingly engaged with all of said knives, a bushing mounted on said polygonal portion of the shaft and extending between the chopper knife and cutter knife engaged with the surface of the mincer plate remote from the pump inlet opening.

7. The fish mincer pump as defined in claim 5 wherein said holes through the mincer plate are no greater than ½ inch in diameter whereby fish waste passing through the mincer plate will have its greatest external dimension not larger than ½ inch to comply with regulations requiring that all fish waste pumped back into the ocean be not larger than ½ inch.

8. The fish waste pump as defined in claim 1 wherein said holes through the mincer plate are no greater than ½ inch in diameter whereby fish waste passing through the mincer plate will have its greatest external dimension not larger than ½ inch to comply with regulations requiring that all fish waste pumped back into the ocean be not larger than ½ inch.

9. In combination, a centrifugal pump having a generally cylindrical inlet extension provided with a shear plate and rotatable shear knife associated therewith in which the chopper shear plate includes relatively large openings, a mincer plate and cutter knife mounted in the extension inwardly of and spaced from the shear plate, said mincer plate including a plurality of relatively small holes extending therethrough with the cutter knife associated with the mincer plate mincing all material passing through the mincer plate to discharge such material into the pump with such material having a maximum dimension equal to the maximum dimension of the holes in the mincer plate.

10. The combination as defined in claim 9 wherein said holes in the mincer plate are not greater than ½ inch.

11. The combination as defined in claim 9 wherein said mincer plate includes a cutter knife associated with each side of the mincer plate to assure shearing of all material passing through the mincer plate.

12. A fish mincer assembly comprising a centrifugal pump including a casing having a suction inlet in one wall thereof and a tangential discharge, an impeller in said casing connected to and driven by pump shaft means, said casing including an inlet extension extending outwardly from said suction inlet, said pump shaft means extending through said inlet extension, a shear plate mounted on an end of said inlet extension remote from said suction inlet, said shear plate including a plurality of large openings, a shear knife mounted on said pump shaft means with the shear knife including sharpened edge portions associated with a surface of said shear plate remote from said suction inlet, a mincer plate mounted in said inlet extension between the shear plate and suction inlet, said mincer plate being spaced axially from the shear plate and including a plurality of small holes extending therethrough, a cutter blade drivingly connected to said pump shaft means, said cutter blade being disposed in spaced relation to the shear plate and including sharpened edge portions closely associated with a surface of said mincer plate to chop, shear and mince fish waste passing through the holes in the mincer plate whereby all fish waste passing into the suction inlet of the centrifugal pump will have a maximum size determined by the size of the holes in the mincer plate.

13. The fish mincer assembly as defined in claim 12 together with a second cutter blade having sharpened edge portions closely associated with a surface of said mincer plate, said cutter blades being associated with opposed surfaces of the mincer plate.

* * * * *